US007341432B2

(12) United States Patent
Sung et al.

(10) Patent No.: US 7,341,432 B2
(45) Date of Patent: Mar. 11, 2008

(54) APPARATUS AND METHOD FOR CONTROLLING OPERATION OF RECIPROCATING COMPRESSOR

(75) Inventors: Ji-Won Sung, Seoul (KR); Chel-Woong Lee, Seoul (KR); Jae-Yoo Yoo, Gwangmyeong (KR); Hyuk Lee, Siheung (KR); Hyung-Jin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 729 days.

(21) Appl. No.: 10/668,153

(22) Filed: Sep. 24, 2003

(65) Prior Publication Data

US 2004/0071556 A1 Apr. 15, 2004

(30) Foreign Application Priority Data

Oct. 15, 2002 (KR) ..... 10-2002-0062949

(51) Int. Cl.
*F04B 49/06* (2006.01)

(52) U.S. Cl. ..... 417/44.1; 417/212; 318/459; 318/119

(58) Field of Classification Search ..... 417/212; 318/119, 459

See application file for complete search history.

(56) References Cited

U.S. PATENT DOCUMENTS

| | | | | |
|---|---|---|---|---|
| 4,664,685 | A * | 5/1987 | Young | 62/6 |
| 6,670,784 | B2 * | 12/2003 | Odachi et al. | 318/700 |
| 6,851,934 | B2 * | 2/2005 | Yoo et al. | 417/44.11 |
| 6,869,272 | B2 * | 3/2005 | Odachi et al. | 417/44.1 |
| 7,025,571 | B2 * | 4/2006 | Jeun | 417/44.11 |
| 2002/0051710 | A1 * | 5/2002 | Yoo et al. | 417/44.11 |
| 2002/0064464 | A1 * | 5/2002 | Hwang et al. | 417/44.11 |
| 2003/0180151 | A1 * | 9/2003 | Jeun | 417/44.11 |
| 2004/0066163 | A1 * | 4/2004 | Yoo et al. | 318/632 |

* cited by examiner

*Primary Examiner*—Lincoln Donovan
*Assistant Examiner*—Antony Paul
(74) *Attorney, Agent, or Firm*—Greenblum & Bernstein, P.L.C.

(57) ABSTRACT

An apparatus and a method for controlling operation of a reciprocating compressor is capable of reducing a stroke estimation error by eliminating an error that occurs due to resistance and inductance of a compressor motor by estimating a stroke with a counter electromotive force induced by a searching coil. Furthermore, by leaving errors of inductance and resistance, among all motor parameters, out of consideration in stroke estimation, a stroke estimation error can be reduced.

18 Claims, 4 Drawing Sheets

APPARATUS AND METHOD FOR CONTROLLING OPERATION OF RECIPROCATING COMPRESSOR

BACKGROUND OF THE INVENTION

1. Field of the Invention

The present invention relates to an apparatus and a method for controlling operation of a reciprocating compressor. In particular, the present invention relates to an apparatus and a method for controlling operation of a reciprocating compressor that is capable of reducing a stroke estimation error by estimating a stroke with a counter electromotive force induced by a searching coil and removing an error due to resistance and inductance in a compressor motor (hereinafter, referred to as a motor).

2. Description of the Prior Art

FIG. 1 is a block diagram illustrating an operation control apparatus of a reciprocating compressor in accordance with the conventional art. As depicted in FIG. 1, the operation control apparatus of the reciprocating compressor includes a current detector 150 for detecting current applied to a motor; a voltage detector 140 for detecting a voltage applied to the motor; a stroke estimator 130 for estimating a stroke on the basis of the detected current, voltage and a motor constant; a comparator 100 for comparing the estimated stroke with a preset stroke reference value and outputting a difference value according to the comparison result; and a controller 110 for controlling a stroke of the compressor by varying a voltage applied to the motor according to the difference value.

Hereinafter, the operation of the control apparatus of the reciprocating compressor will be described with reference to accompanying FIG. 2.

First, the current detector 150 detects current applied to the motor, and the voltage detector 140 detects a voltage applied to the motor. Herein, the stroke estimator 130 calculates a stroke estimation value of the compressor with Equation 1 by substituting the detected current value, the detected voltage value and a motor constant and applies the calculated stroke estimation value to the comparator 100.

$$X = \frac{1}{\alpha}\int (V_M - Ri - L\dot{i})dt \qquad \text{Equation 1}$$

Herein, R is the resistance of the motor, L is the inductance of the motor, $\alpha$ is a motor parameter, $V_M$ is the voltage of the motor and i is the current of the motor.

Then, the comparator 100 compares the stroke estimation value with the stroke reference value (S220) and applies a difference value according to the comparison result to the controller 110. The controller 110 controls a stroke by varying the voltage applied to the motor on the basis of the difference value.

In more detail, the control unit 110 increases a motor supply voltage (S240) when a stroke reference value is greater than a stroke estimation value, and the control unit 110 decreases a motor supply voltage (S230) when a stroke reference value is less than a stroke estimation value.

However, in the conventional operation control method of the reciprocating compressor, because stroke control is performed by estimating a stroke utilizing all motor parameters (motor constant, resistance, inductance, etc.), an error in an estimated stroke is increased due to errors and nonlinearity of the parameters.

SUMMARY OF THE INVENTION

In order to solve the above-mentioned problem, it is an object of the present invention to provide an apparatus and a method for controlling operation of a reciprocating compressor that is capable of reducing a stroke estimation error by leaving errors of inductance and resistance, among all motor parameters, out of consideration by estimating a stroke with a counter electromotive force induced by a searching coil.

In order to achieve the above-mentioned object, an operation control apparatus of a reciprocating compressor accordance with the present invention includes a compressor in which includes a searching coil, a first stroke estimator that estimates a first stroke value by using a voltage, a current applied to a motor of the compressor and a motor constant and a phase difference detector that detects a phase difference value between a phase of the first stroke value and a phase of the current applied to the motor. A searching coil voltage detector detects a voltage applied to both ends of the searching coil based upon the phase difference detected by the phase difference detector and a counter electromotive force extractor extracts a counter electromotive force induced by the searching coil in accordance with the phase difference detected by the phase difference detector. A second stroke estimator estimates a second stroke value based upon the extracted counter electromotive force and a control unit compares the second stroke estimation value with a stroke reference value and varies one of a voltage applied to the motor and an operational frequency of the compressor in accordance with a result of the comparison.

In addition, the present invention relates to a method of controlling operation of a reciprocating compressor in includes estimating a first stroke estimation value by using current and a voltage applied to a motor of a compressor and a motor constant, calculating a difference between a phase of the first stroke estimation value and a phase of the current applied to the motor and judging whether the phase difference is 90°. Detecting a counter electromotive force by using a voltage applied to the both ends of a searching coil when the phase difference is 90° and estimating a second stroke estimation value based upon the counter electromotive force; and comparing the second stroke estimation value with a stroke reference value and varying a voltage applied to the motor based upon the result of the comparison.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

In the drawings.

DETAILED DESCRIPTION OF THE PREFERRED EMBODIMENT

In an apparatus and a method for controlling operation of a reciprocating compressor in accordance with the present invention, after calculating a stroke estimation value by the same method as in the conventional art, in order to reduce an error due to inductance and resistance elements used in the estimation value calculation, a phase of the calculated stroke is compared with a phase of a current applied to the motor compressor. When the comparison result yields a phase difference of 90°, a new stroke is estimated, and when the comparison result yields a phase difference that is not 90°, an operational frequency applied to the motor is varied, and accordingly accuracy of the stroke control can be improved.

In more detail, after detecting a first stroke estimation value based upon a voltage and current applied to the motor and upon a motor constant, a difference between a phase of the first stroke estimation value and a phase of the current applied to the motor is calculated. Herein, when a phase difference is 90°, a size and a phase of a voltage applied to the both ends of a searching coil are detected. After detecting a phase of the current applied to the motor, a phase of magnetic flux induced by the voltage applied to the motor (hereinafter referred to as magnetic flux of the motor) is calculated by using the phase current, and the difference between the magnetic flux phase and the voltage phase applied to the both ends of the searching coil is calculated.

Afterward, by using the difference between the magnetic flux phase and the voltage phase, a size of a counter electromotive force induced by the searching coil (hereinafter referred to as the counter electromotive force) is detected, a second stroke estimation value is calculated utilizing the size of the counter electromotive force. The second stroke estimation value is compared with the stroke reference value, and a voltage applied to the motor is varied according to the comparison result. Accordingly, the stroke of the compressor is controlled.

On the other hand, when difference between the phase of the first stroke estimation value and the phase of the motor current is not 90°, the operational frequency of the motor is varied. In particular, when the phase difference is greater than 90°, an operational frequency is increased, and when the phase difference is less than 90°, an operational frequency is decreased.

Hereinafter, the apparatus and the method for controlling the operation of the reciprocating compressor in accordance with an embodiment of the present invention will be described with reference to the accompanying drawings.

Figure 1:
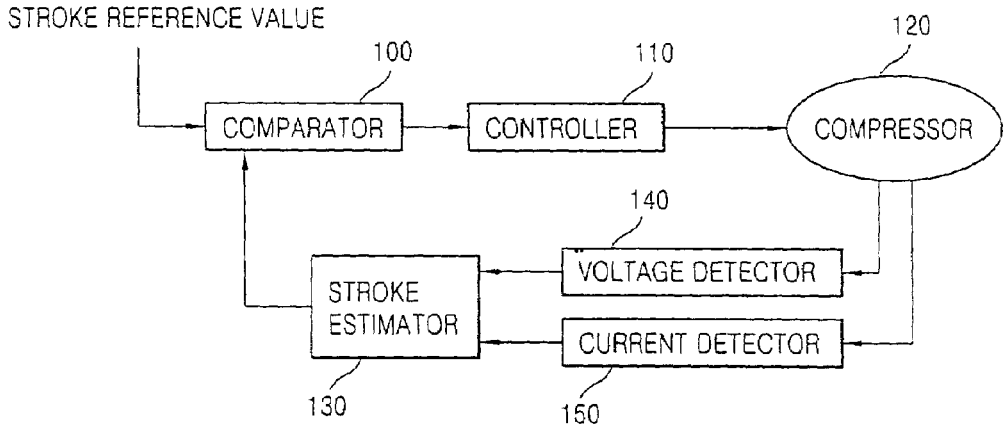
FIG. 1 CONVENTIONAL ART
FIG. 1 is a block diagram illustrating an operation control apparatus of a reciprocating compressor in accordance with the conventional art.
Figure 2:
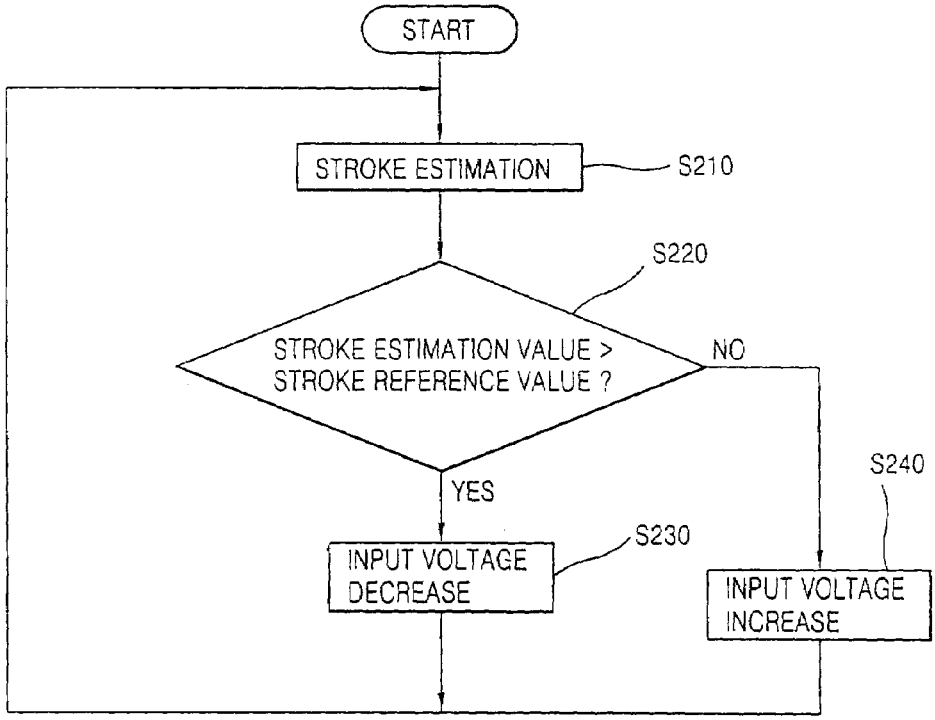
FIG. 2 CONVENTIONAL ART
FIG. 2 is a flow chart illustrating an operation control method of a reciprocating compressor in accordance with the conventional art.
Figure 3:
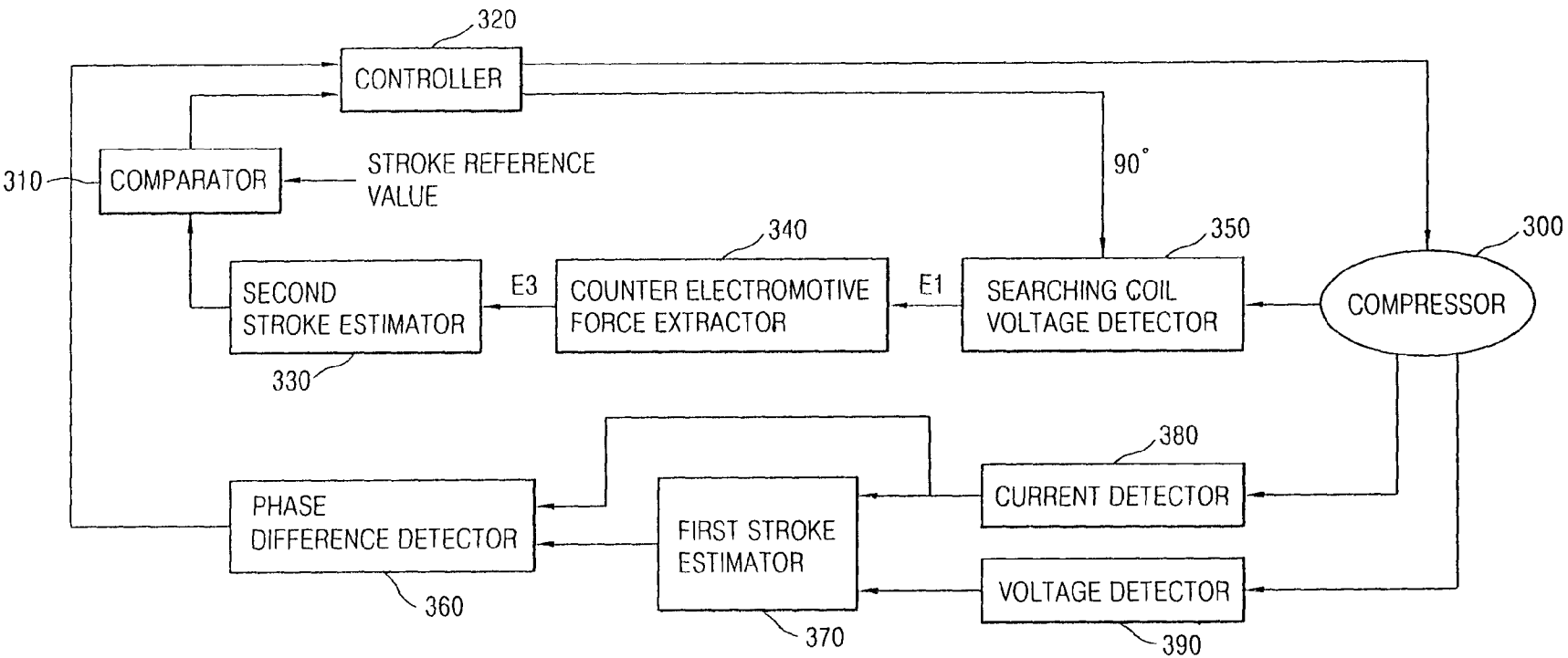
FIG. 3 is a block diagram illustrating an operation control apparatus of a reciprocating compressor in accordance with an embodiment of the present invention.

FIG. 3 is a block diagram illustrating an operation control apparatus of a reciprocating compressor in accordance with the present invention. As depicted in FIG. 3, the operation control apparatus includes a voltage detector 390 for detecting a voltage applied to the motor of a compressor 300; a current detector 380 for detecting current applied to the motor; a first stroke estimator 370 for estimating a first stroke by using the voltage, the current and a constant of the motor; a phase difference detector 360 for detecting a difference value between a phase of the stroke estimation value from the first stroke estimator 370 with a phase of the motor current; a searching coil voltage detector 350 for detecting a voltage applied to a searching coil according to the detected phase difference; a counter electromotive force extractor 340 for extracting a counter electromotive force by receiving the detected voltage; a second stroke estimator 330 for estimating a second stroke by using the counter electromotive force; a comparator 310 for comparing the second stroke estimation value with the stroke reference value and outputting a comparison value according to the comparison result; and a control unit 320 for controlling a stroke by varying the voltage applied to the motor according to the comparison result from the comparator 310.

Herein, the voltage E1 detected by the searching coil voltage detector 350 is the sum total of the motor magnetic flux and the counter electromotive force, and it can be calculated by utilizing Equation 2. In addition, the motor magnetic flux E2, defined by Equation 3 can be obtained by utilizing the basic information of the motor itself, and a phase of E2 has the same shape as a phase of the current applied to the motor. By using Equations 2 and 3, the following Equation 4 can be obtained for the counter electromotive force E3. The counter electromotive force extractor 340 calculates a counter electromotive force by using Equation 4.

$$E1 = N\frac{d\Phi_A}{dt} + \alpha\bar{x} \qquad \text{Equation 2}$$

$$E2 = N\frac{d\Phi_A}{dt} \qquad \text{Equation 3}$$

$$E3 = \alpha\bar{x} \qquad \text{Equation 4}$$

Herein, N is the number coils that are wound around the motor, $\Phi_A$ is magnetic flux of the motor, $\alpha$ is a motor constant, and $$\bar{x}\left(=\frac{dx}{dt}\right)$$

is a piston speed.

Accordingly, by substituting Equation 4 showing the counter electromotive force calculated in the counter electromotive force extractor 340 for following Equation 5, a second stroke estimation value can be obtained.

$$x = \frac{1}{\alpha}\int(\alpha\bar{x})dt \qquad \text{Equation 5}$$

Herein, x is a second stroke estimation value.

Figure 4:
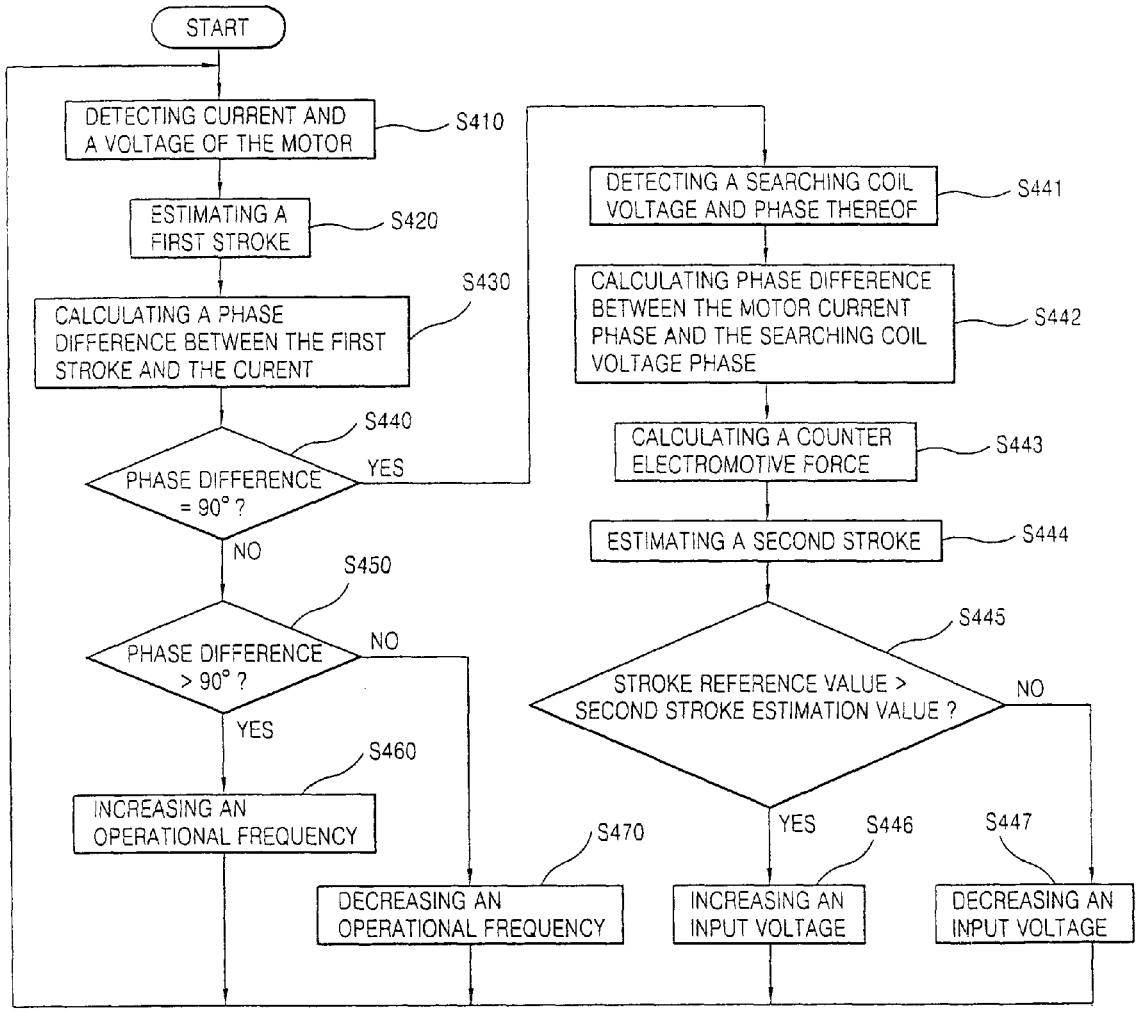
FIG. 4 is a flow chart illustrating an operation control method of a reciprocating compressor in accordance with an embodiment of the present invention.
Figure 5:
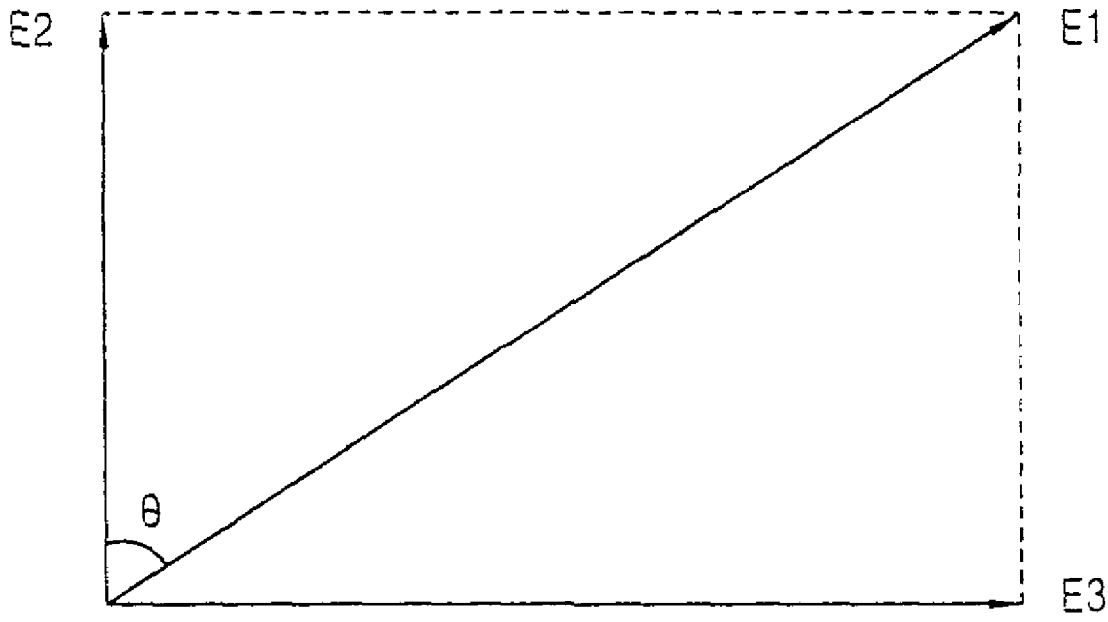
FIG. 5 is a mimetic diagram illustrating a method for calculating a counter electromotive force induced by a searching coil in accordance with an embodiment of the present invention.

The operation control method of the reciprocating compressor in accordance with the present invention will be described with reference to accompanying FIGS. 4 and 5.

First, the current detector 380 detects the current applied to the motor, and the voltage detector 390 detects the voltage applied to the motor as shown at step S410. Herein, the first stroke estimator 370 calculates a first stroke estimation value with the current, the voltage and a constant of the motor by using Equation 1 as shown at step S420 and applies it to the phase difference detector 360.

Accordingly, the phase difference detector 360 detects a phase difference between a phase of the first stroke estimation value with a phase of the current applied to the motor and applies the difference to the controller 320 as shown at step S430. Then, when the phase difference is greater than 90°, the controller 320 increases an operational frequency applied to the compressor as shown at steps S450 and S460, and when the phase difference is less than 90°, the controller 320 decreases an operational frequency applied to the compressor as shown at steps S450 and S470. Accordingly, a stroke of the compressor 300 is controlled.

When a phase detected in the phase difference detector 360 is 90°, the controller 320 applies the voltage which is applied to the both ends of the searching coil detected by the searching coil voltage detector 350 to the counter electromotive force extractor 340 as shown at steps S440 and S441. Herein, the voltage applied to the both ends of the searching coil is the total sum of the magnetic flux of the motor and the counter electromotive force, which can be calculated by Equation 2.

Afterward, the counter electromotive force extractor 340 extracts only the counter electromotive force E3 from the voltage applied to the both ends of the searching coil and applies it to the second stroke estimator 330. Herein, as depicted in FIG. 5, the counter electromotive force extractor 340 calculates the counter electromotive force by using Equation 4 through Equations 2 and 3.

In other words, by using a size (i.e., magnitude) and a phase of E1 and E2, a size and a phase of E3 can be calculated. In more detail, by using a difference between a phase of the voltage applied to the both ends of the searching coil (phase of E1) and a phase of the motor magnetic flux (phase of E2), a size and a phase of the counter electromotive force (E3) can be detected. Herein, because a difference between a phase of E2 and a phase of E3 is 90°, a size of the counter electromotive force (E3) has a sin θ connection (i.e., relationship) with a size of the voltage (E1) applied to the both ends of the searching coil. Herein, θ is a difference between a phase of the motor magnetic flux and a phase of the voltage applied to the both ends of the searching coil as shown at steps S442 and S443.

Then, the second stroke estimator 330 estimates a second stroke with the counter electromotive force (E3) and applies it to the comparator 310. Herein, the second stroke estimation value can be calculated by utilizing Equation 5 as shown at step S444.

According to the above description, the comparator 310 compares the second stroke estimation value with the stroke reference value and applies a difference signal according to the comparison result to the controller 320, and the controller 320 controls a stroke by varying the voltage applied to the motor. In more detail, when the stroke reference value is greater than the second stroke estimation value, the controller 320 increases a voltage input to the motor as shown at steps S445 and S446. On the other hand, when the stroke reference value is less than the second stroke estimation value, the controller 320 decreases a voltage input to the motor as shown at steps S445 and S447.

As described above, in the present invention, after detecting a counter electromotive force induced by a searching coil, by estimating a stroke with the counter electromotive force, there is no need to consider error of inductance and resistance among motor parameters, and accordingly it is possible to reduce a stroke estimation error.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. An operation control apparatus of a reciprocating compressor, comprising:

a compressor including a searching coil;

a first stroke estimator that estimates a first stroke value by using a voltage and a current applied to a motor of the compressor and a motor constant;

a phase difference detector that detects a phase difference between a phase of the first stroke value and a phase of the current applied to the motor;

a searching coil voltage detector that detects a voltage applied to both ends of the searching coil based upon the phase difference detected by the phase difference detector;

a counter electromotive force extractor that extracts a counter electromotive force induced by the searching coil in accordance with the phase difference detected by the phase difference detector;

a second stroke estimator that estimates a second stroke value based upon the extracted counter electromotive force; and a controller that compares the second stroke value with a stroke reference value and varies one of a voltage applied to the motor and an operational frequency of the compressor in accordance with a result of the comparison.

2. The apparatus of claim 1, wherein the first stroke estimator estimates the first stroke value by using the following equation $$X = \frac{1}{\alpha}\int (V_M - Ri - L\dot{i})dt$$

wherein, $V_M$ is the motor voltage, i is a motor current, R is resistance of the motor, L is inductance of the motor, and α is a motor parameter.

3. The apparatus of claim 1, wherein the controller applies a voltage which is applied to the both ends of the searching coil detected by the searching coil voltage detector to the counter electromotive force extractor, when a difference between a phase of the first stroke value and a phase of the current applied to the motor is 90°.

4. The apparatus of claim 1, wherein the controller varies an operational frequency of the motor when a difference between a phase of the first stroke value and a phase of the current applied to the motor is not 90°.

5. The apparatus of claim 1, wherein the searching coil voltage detector detects a voltage applied to both ends of the searching coil by using following Equation $$El = N\frac{d\Phi_A}{dt} + \alpha\bar{x}$$

wherein, N is the number of times that the coil is wound around the motor, $\Phi_A$ is magnetic flux of the motor, α is a motor constant, and $\bar{x}$ is a piston speed.

6. The apparatus of claim 1, wherein the counter electromotive force extractor extracts the counter electromotive force from the voltage applied to both ends of the searching coil by using following Equation $$E3=\alpha\bar{x}$$

herein, $\alpha$ is a motor constant, and $\bar{x}$ is a piston speed.

7. The apparatus of claim 6, wherein a magnitude of the counter electromotive force is calculated by multiplying sin $\theta$ by a magnitude of the voltage applied to the both ends of the searching coil, wherein $\theta$ is a difference between a motor magnetic flux phase and a voltage phase applied to the both ends of the searching coil.

8. The apparatus of claim 1, wherein the second stroke estimator estimates a second stroke value by using the following Equation $$x = \frac{1}{\alpha}\int(a\bar{x})dt$$

wherein, $\alpha$ is a motor constant, and x is a second stroke estimation value.

9. A method of controlling operation of a reciprocating compressor, comprising:

estimating a first stroke value by using a current and a voltage applied to a motor of a compressor and a motor constant;

calculating a difference between a phase of the first stroke estimation and a phase of the current applied to the motor and judging whether the difference is 90°;

detecting a counter electromotive force based upon a voltage applied to both ends of a searching coil when the phase difference is 90°and estimating a second stroke value with the counter electromotive force; and comparing the second stroke value with a stroke reference value and varying a voltage applied to the motor based upon the result of the comparison.

10. The method of claim 9, further comprising increasing an operational frequency of the compressor when difference between a phase of the first stroke value and a phase of the current applied to the motor is greater than 90°.

11. The method of claim 9, further comprising decreasing an operational frequency of the compressor when a difference between phase of the first stroke value and a phase of the current applied to the motor is less than 90°.

12. The method of claim 9, wherein judging the second stroke value includes:

detecting a size and a phase of a voltage applied to both ends of the searching coil;

calculating a phase of a motor magnetic flux based upon a phase of the current applied to the motor;

calculating a magnitude of a counter electromotive force based upon a difference between the calculated phase of the magnetic flux and the phase of the voltage applied to both ends of the searching coil; and calculating a second stroke value based upon the calculated size of the counter electromotive force.

13. The method of claim 12, wherein a magnitude of the counter electromotive force is calculated by multiplying sin $\theta$ by a size of the voltage applied to both ends of the searching coil, wherein $\theta$ is difference between a phase of the motor magnetic flux and a phase of the voltage applied to both ends of the searching coil.

14. The method of claim 9, wherein varying the voltage includes:

comparing the second stroke value with a stroke reference value; and increasing a voltage applied to the motor when the stroke reference value is greater than the second stroke value based upon a result of the comparison result.

15. The method of claim 14, wherein the varying further includes:

decreasing a voltage applied to the motor when the stroke reference value is less than the second stroke value based upon a result of the comparison.

16. In a method of controlling operation of a reciprocating compressor by estimating a stroke of a compressor motor and performing stroke control with the estimated stroke, the method comprising:

calculating a magnitude of a counter electromotive force when a difference between a phase of the estimated stroke and a phase of the current applied to the motor is 90°;

calculating a new stroke value based on the magnitude of the counter electromotive force; and comparing the new stroke value with a stroke reference value and varying a voltage applied to the motor in accordance with a result of the comparison.

17. The method of claim 16, wherein varying the voltage includes:

comparing the new stroke value with a stroke reference value; and increasing a voltage applied to the motor when the stroke reference value is greater than the new stroke value based upon a result of the comparison.

18. The method of claim 17, wherein varying the voltage includes:

decreasing a voltage applied to the motor when the stroke reference value is less than the new stroke based upon a result of the comparison value in the comparison result.

* * * * *